US005882111A

United States Patent [19]

Chen

[11] Patent Number: 5,882,111

[45] Date of Patent: Mar. 16, 1999

[54] DISPLAY DEVICE SPECIALLY USED WITH A DART TARGET FOR THE GAME OF CRICKET

[76] Inventor: Wen-Kai Chen, 16th Fl.-4, No. 773, Tatun Rd., Nantun Dist., Taichung, Taiwan

[21] Appl. No.: 877,236

[22] Filed: Jun. 17, 1997

[51] Int. Cl.[6] ..... G08B 23/00; F41J 5/00

[52] U.S. Cl. ..... 364/411.1; 273/371; 340/323 R

[58] Field of Search ..... 463/1, 30–31, 463/36; 364/410, 411, 410.1, 411.1; 340/323 R; 273/371–376, 401, 408, DIG. 26

[56] References Cited

U.S. PATENT DOCUMENTS 5,531,451 7/1996 Yiu ..... 273/371
5,648,752 7/1997 Afey ..... 273/371

OTHER PUBLICATIONS

The American Darts Organization Book of Darts, by Chris Carey copyright 1993, cover and pp. 32–46.

*Primary Examiner*—Jessica J. Harrison
*Assistant Examiner*—Mark A. Sager
*Attorney, Agent, or Firm*—Watson Cole; Grindle Watson P.L.L.C.

[57] ABSTRACT

A display device specially used with a dart target for the game of cricket, which has a simplified structure, a reduced volume and a low power consumption, is disclosed. The display device used with a dart target for cricket includes a personal qualification display composed of a plurality sets of luminous elements for illustrating qualification states of scores of respective one of the players, and a prompting display composed of a plurality of luminous elements each of which relates to a corresponding set of the luminous elements of the personal qualification display and a corresponding score for showing the present player that other players have been qualified for specific scores.

2 Claims, 4 Drawing Sheets

DISPLAY DEVICE SPECIALLY USED WITH A DART TARGET FOR THE GAME OF CRICKET

BACKGROUND OF THE INVENTION

1. Field of the Invention

The present invention relates to a display device, and more particularly to a display device specially used with a dart target for the game of cricket, which has a simplified structure, a reduced volume and a low power consumption.

2. Description of Related Art

A conventional display device used with a dart target for the game of cricket typically has a structure as shown in FIG. 4. The dart target has a target 50 divided into several sectors and a control panel (not numbered) disposed below the target 50. The control panel includes a key region 51, four total score display areas 52 each of which comprises a three-byte aggregate score for illustrating the total score of a corresponding user, four one-turn score display areas 53 each of which comprises a two-byte aggregate score for illustrating the score of this turn, four pilot lamps 54 for identifying players, a function indicator light 55 formed of a plurality of light-emitting diodes and four qualification display groups 56. Each qualification display group 56 comprises 21 light-emitting diodes in an array of 7 by 3 (7×3) pattern. In this cricket game, only the scores of 20, 19, 18, 17, 16, 15, and "BULL" are counted, others are not counted. Moreover, every player has to hit the same score three times before the score is counted effective, therefore the four qualification display groups 56 illustrate the qualification of each score (including scores 20, 19, 18, 17, 16, 15, and "BULL") of all the player. However, the same score become ineffective if every one of the players has hit the corresponding region of the score at least three times. For showing the potentially effective/ineffective scores, this kind of display device uses a total of 84 light-emitting diodes as the required qualification display groups which results in a disadvantageous complex circuit structure with a high power consumption and occupying space.

The present invention provides an improved display device used with a dart target for the game of cricket to mitigate and/or obviate the aforementioned problems.

SUMMARY OF THE INVENTION

One object of the present invention is to provide a display device specially used with a dart target for the game of cricket which only requires a single qualification display groom for sequentially displaying the current qualification state of a respective one of the players and a prompting display for showing the present player that other players have been qualified for specific scores. With this simplified structure, this display device has a reduced volume and a low power consumption.

In accordance with one aspect of the present invention, there is provided a display device used with a dart target separated into a plurality of scoring areas and allowing players to play a cricket game thereon, the display device comprising a personal qualification display composed of a plurality sets of luminous elements for illustrating qualification states of scores of respective one of the players, and a prompting display composed of a plurality of luminous elements each of which relates to a corresponding score for showing the present player that other players have been qualified for specific scores.

In accordance with another aspect of the present invention, the personal qualification display is configured to be a liquid crystal pattern and each luminous element of the prompting display is constituted by a luminous border.

In accordance with a further aspect of the present invention, the luminous elements in each set of the personal qualification display are light-emitting diodes and each luminous element of the prompting display is a light-emitting diode.

In accordance with still a further aspect of the present invention, each set of the luminous elements of the personal qualification display is adjacent to a corresponding scoring area of the dart target and a corresponding luminous element of the prompting display.

Other objects, advantages and novel features of the invention will become more apparent from the following detailed description when taken in conjunction with the accompanying drawings.

DETAILED DESCRIPTION OF PREFERRED EMBODIMENT

Figure 1:
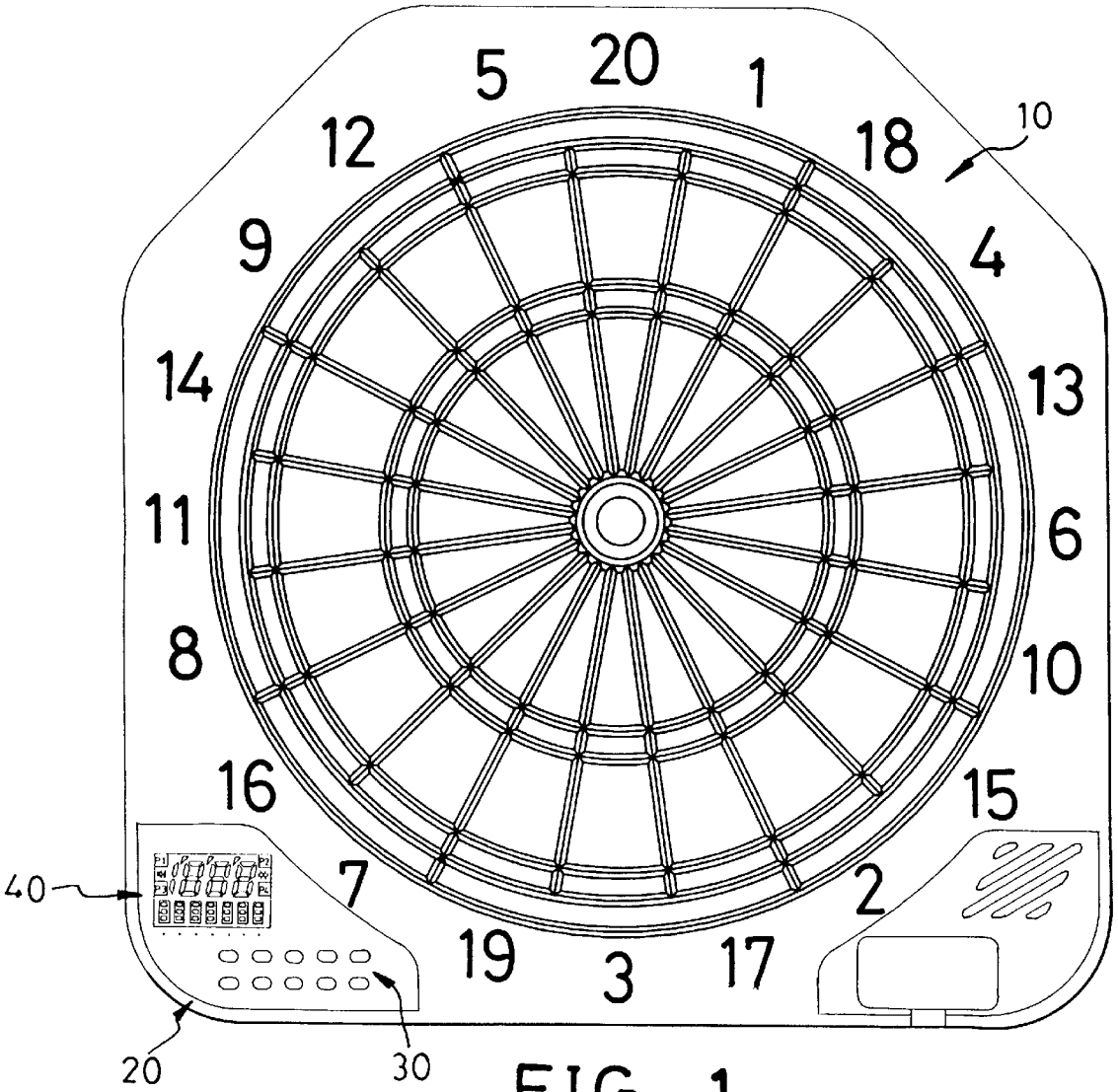
FIG. 1 is a schematic view showing a display device used with a dart target for cricket in accordance with a first embodiment of this invention.
Figure 4:
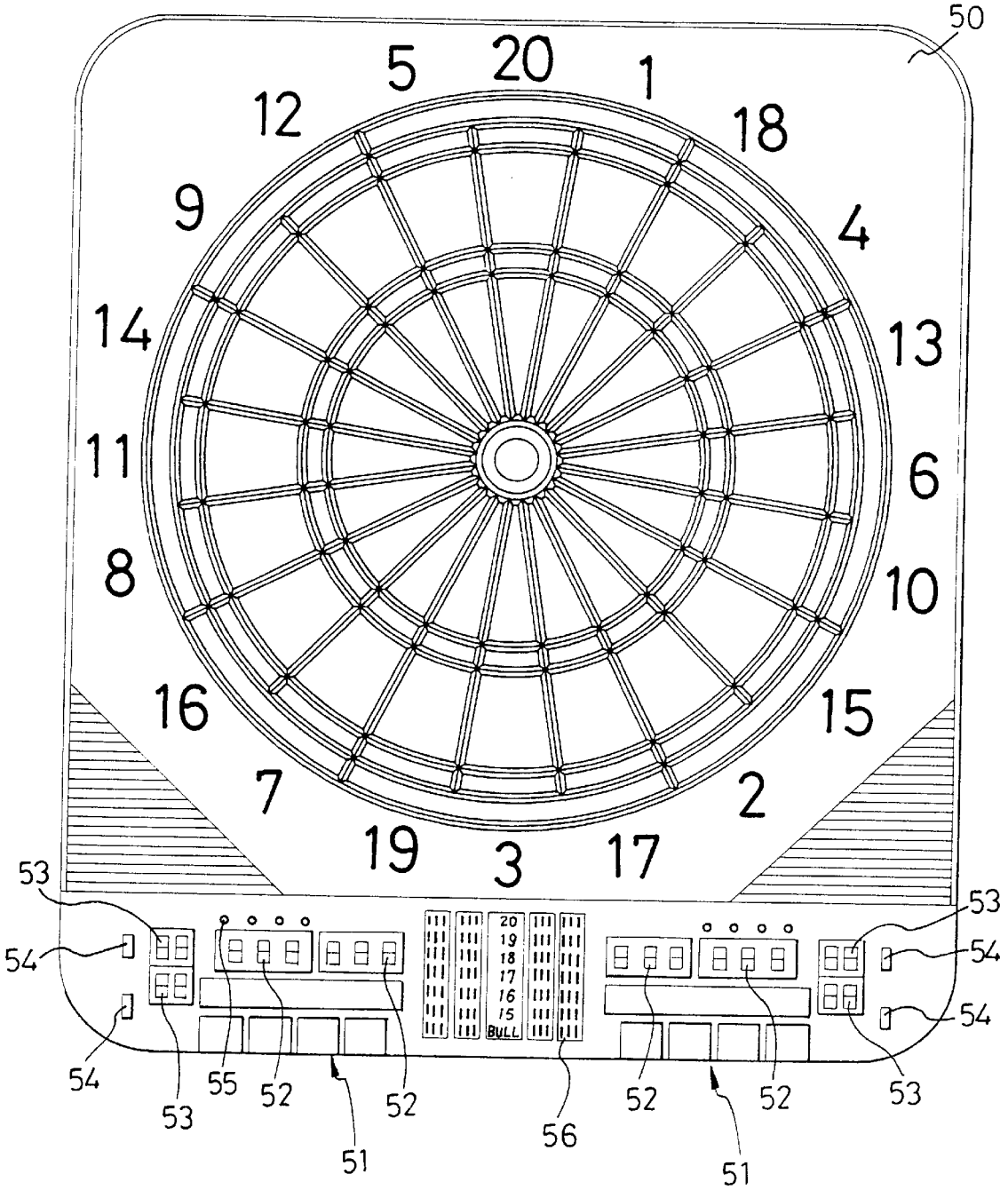
FIG. 4 PRIOR ART
FIG. 4 is a schematic view showing a conventional dart target.

Referring to FIG. 1, a display device used with a dart target in a cricket game in accordance with the present invention comprises a control panel 20 having a key region 30 and a display region 40, which is combined into the dart target so that a control panel with a large volume and high power-consumption can be removed. The display region 40 of the control panel 20 has a configuration as shown in FIG. 2A. An upper portion of the display region 40 forms a multidigital score display area 41, which has an identification area 42 arranged therearound. The identification area 42 includes a plurality of pilot lamps P1, P2, P3, P4 provided for respectively displaying each of four players. When one pilot lamp of the identification area 42 is highlighted, it can be determined which corresponding player is performing and the score of that player will be simultaneously displayed in the score display area 41. Therefore, the combined score display area 41 and the identification area 42 function as a plurality of digital displays of a conventional control panel. In addition, three digital display areas 43 are arranged over the score display area 41 for displaying the number of darts thrown by the current player. A sound identification area 44 and a power display area 45 are respectively provided at either side of the score display area 41 for transmitting sound and indicating power level. A personal qualification display 46 used with a dart target is located below the display region 40. The personal qualification display 46 is composed of seven sets each having three display blocks 461, which is similar to a display area (not numbered) used in the display device of FIG. 4. Each set of the display blocks 461 is enclosed by a luminous border 462. All the luminous borders 462 together function as a prompting display for showing the present player that other players have been qualified for specific scores. More specifically, when the border 462 is highlighted, it is indicated that the current player should try to hit with a dart the scoring areas indicated by the corresponding display blocks 461, or another player will score (this being a basic rule of cricket, detailed description has been described previously). The personal qualification display and the prompting display may be made of liquid crystal, electroluminescent lights, lamps, or other components. Accordingly, the present invention provides one display region 40 inside of the control panel of a conventional display device so that the structure can be simplified and the volume thereof can be reduced.

Figure 3:
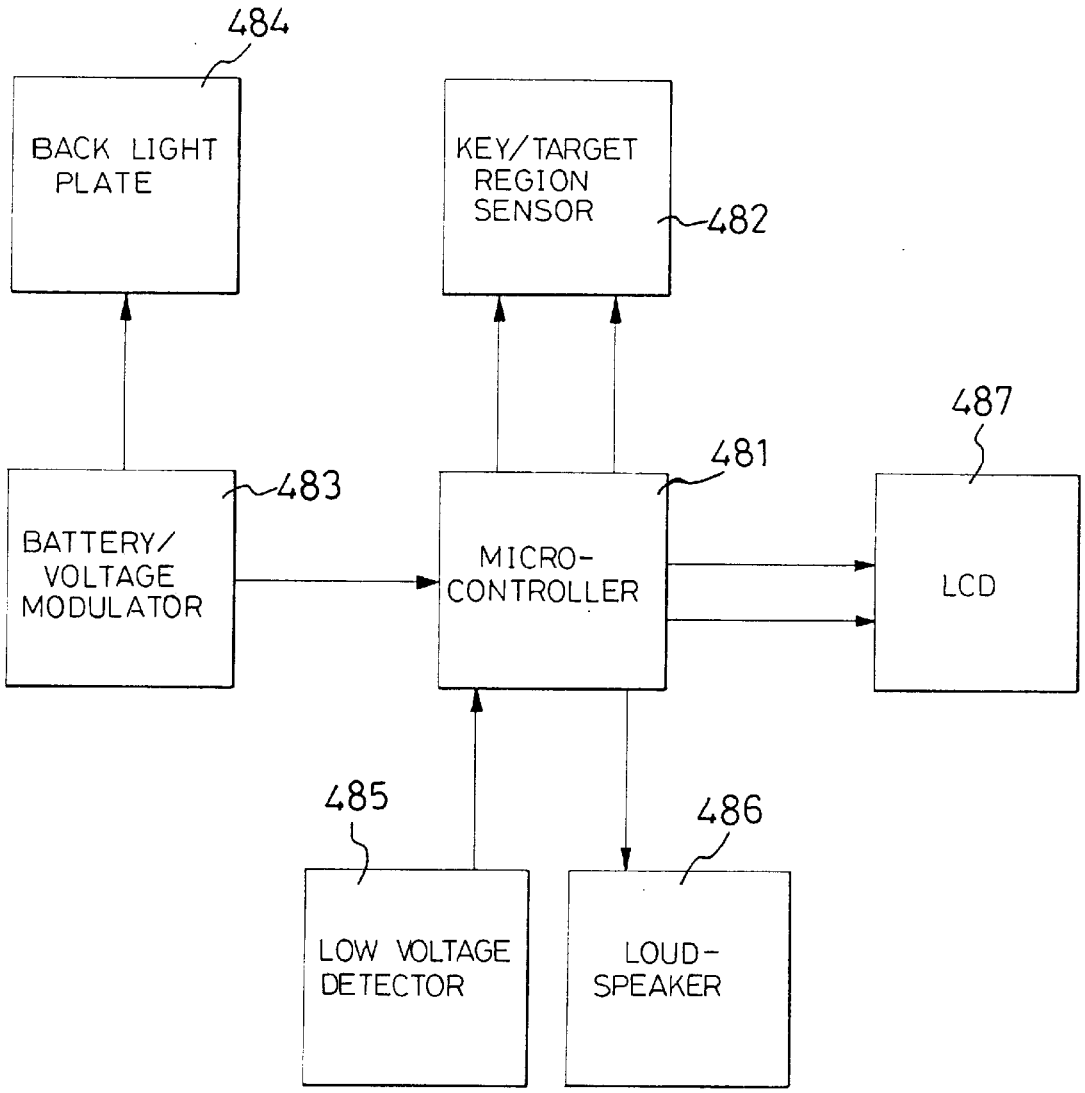
FIG. 3 is a block diagram depicting a circuit of the display device of FIG. 1.

A circuit diagram of the display device of FIG. 1 is shown in FIG. 3. The circuit used for the display device in accordance with the present invention comprises a micro-controller 481 of a liquid crystal driver (not numbered), a liquid crystal display 487 driven by the micro-controller 481, a loudspeaker 486, a low voltage detector 485, a key region/target region sensor 482, a battery/voltage modulator 483 and a back light plate 484. Since the liquid crystal display 487 driven by the micro-controller 481 operates with a low power consumption, the power of the liquid crystal display 487 can be supplied by a battery or by a mains via a voltage regulator (not shown). With the low voltage detector 485 and the power display from the liquid crystal display 487, the dart target can be moved outdoors.

Figure 2B:
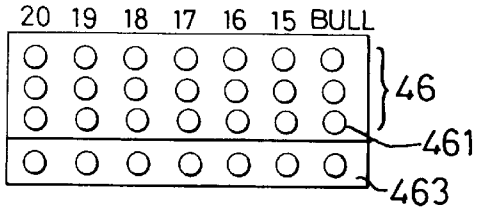
FIG. 2B is a schematic view showing a display device used with a dart target in accordance with a second embodiment of this invention.
Figure 2A:
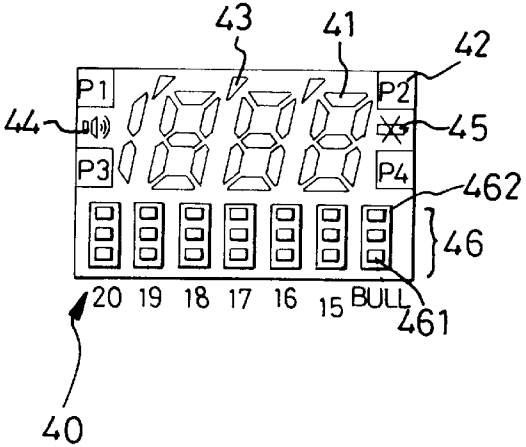
FIG. 2A is an enlarged view showing the display device of FIG. 1.

A second embodiment of the personal qualification display 46 in accordance with the present invention is shown in FIG. 2B. Similar to the first embodiment, the personal qualification display 46 is an array pattern including seven by three (7×3) display elements 461 formed of 7×3 light-emitting diodes. In this embodiment, each column (or set) includes three display elements 461 relating to a corresponding score as indicated at the top thereof. Below each set of the display elements 461, there is disposed a prompting pilot lamp 463. All the prompting pilot lamps 463 constitute a prompting display. When any prompting pilot lamp 463 is highlighted, it is understood that the scoring area indicated by the corresponding display blocks 461 had been hit by another player. Therefore, it has the same prompting effect as the luminous border 462 of the first embodiment.

Figure 2C:
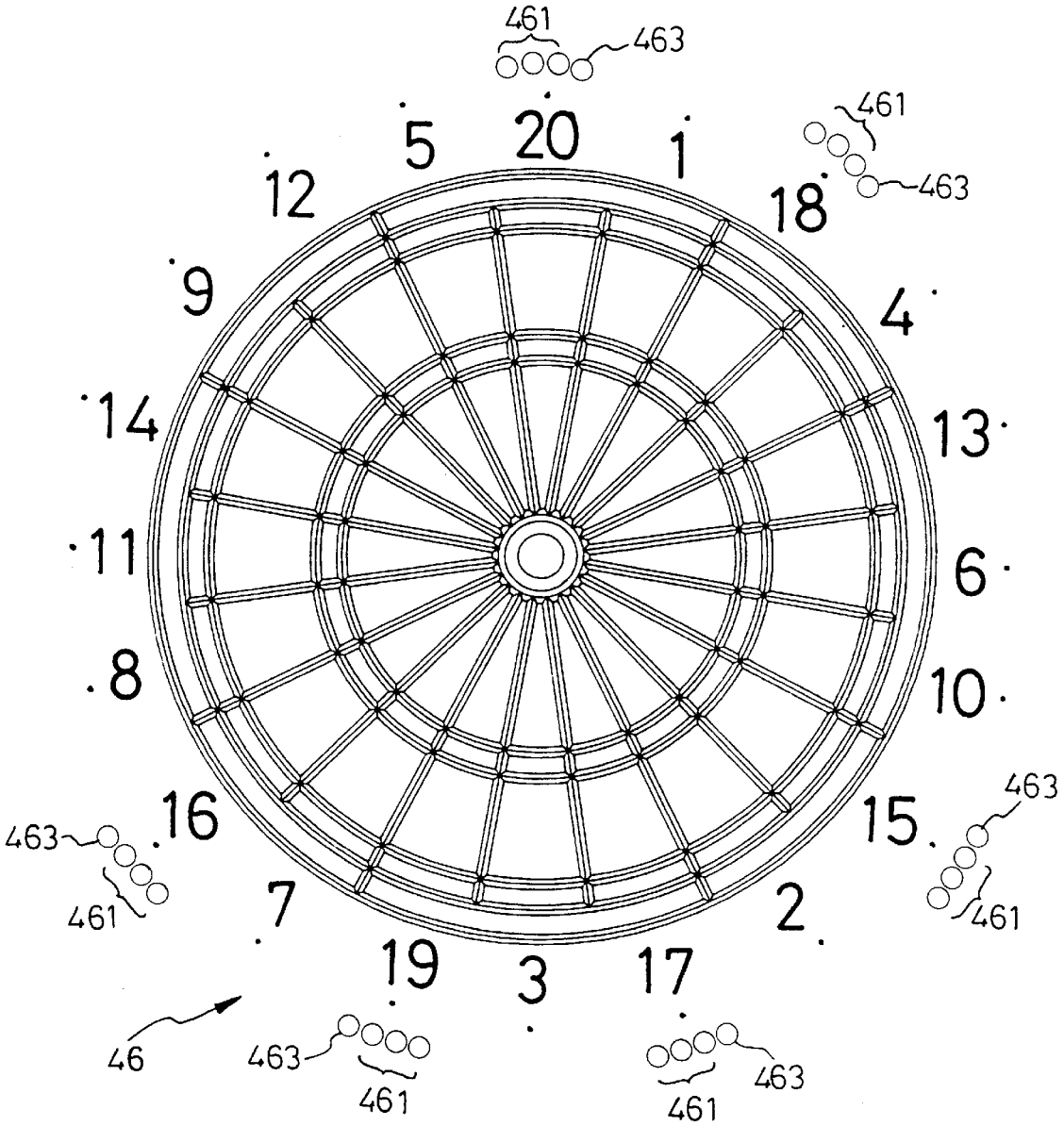
FIG. 2C is a schematic view showing a plurality of display units placed adjacent to the corresponding scoring areas of a dart target in accordance with a third embodiment of this invention.

A third embodiment of the personal qualification display 46 in accordance with the present invention is shown in FIG. 2C. Similar to the second embodiment, the personal qualification display 46 includes seven sets of three consecutive display elements 461 and each set of consecutive display elements is adjacent to a prompting pilot lamp 463 which relates to a corresponding score. All the prompting pilot lamps 463 constitute a prompting display for showing the present player that other players have been qualified for specific scores. The difference between the second embodiment and the third embodiment is that the seven sets of display elements 461 are placed adjacent to the corresponding scoring areas of the target instead of being combined integrally. In this arrangement, the same prompting effect as the second embodiment is achieved.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A scorekeeping device for a cricket game comprising:

a personal qualification display composed of a plurality sets of luminous elements for illustrating qualification states of scores of respective one of the players; and a prompting display composed of a plurality of luminous elements each corresponding to one set of said luminous elements of said personal qualification display and wherein the personal qualification display is configured as a liquid crystal pattern and each luminous element of the prompting display includes a luminous border to enclose a corresponding set of the luminous elements of the personal qualification display.

2. A scorekeeping device for a cricket game comprising:

a personal qualification display composed of a plurality set of luminous elements for illustrating qualification states of scores of respective one of the players; and a prompting display composed of a plurality of luminous elements each corresponding to one of said luminous elements of said personal qualification display, and wherein each set of the luminous elements of the personal qualification display and the corresponding luminous element of the prompting display are adjacent to a scoring area.

* * * * *